US005985817A

United States Patent [19]

Weibel et al.

[11] Patent Number: 5,985,817

[45] Date of Patent: Nov. 16, 1999

[54] POURABLE, THICKENED AQUEOUS BLEACH AND ABRASIVE CONTAINING COMPOSITIONS

[75] Inventors: A. Thomas Weibel, Cranbury; Ann Marie Lynch, Glen Rock; Rosita Gabriella Nunez, Nutley; Helen B. Wang, Manalapan, all of N.J.; Pranil Pooran Hagroo, Durban; Leonard February, Johannesburg, both of South Africa

[73] Assignee: Reckitt & Colman South Africa Ltd., Elandsfontein, South Africa

[21] Appl. No.: 09/027,023

[22] Filed: Feb. 20, 1998

[30] Foreign Application Priority Data

Feb. 24, 1997 [GB] United Kingdom ..... 9703824
Jul. 2, 1997 [GB] United Kingdom ..... 9713880

[51] Int. Cl.[6] ..... C11D 3/395; C11D 3/14; C11D 9/20; C11D 7/54

[52] U.S. Cl. ..... 510/369; 510/380; 510/397; 510/399; 510/418; 510/430

[58] Field of Search ..... 510/368, 369, 510/380, 397, 399, 418, 426, 430

[56] References Cited

U.S. PATENT DOCUMENTS

| | | | |
|---|---|---|---|
| 3,684,722 | 8/1972 | Hynam et al. | 252/98 |
| 4,337,163 | 6/1982 | Schilp | 252/96 |
| 4,695,394 | 9/1987 | Choy et al. | 252/97 |
| 4,842,757 | 6/1989 | Reboa et al. | 252/76 |
| 4,911,857 | 3/1990 | Machin et al. | 252/98 |
| 5,130,043 | 7/1992 | Prince et al. | 252/95 |
| 5,279,755 | 1/1994 | Choy et al. | 252/76 |
| 5,298,181 | 3/1994 | Choy et al. | 252/95 |
| 5,529,711 | 6/1996 | Brodbeck et al. | 252/102 |
| 5,821,214 | 10/1998 | Weibel et al. | 510/368 |

FOREIGN PATENT DOCUMENTS

| | | | |
|---|---|---|---|
| 0 649 898 A2 | 4/1995 | European Pat. Off. | C11D 3/395 |
| WO 95/08619 | 3/1995 | WIPO | C11D 3/16 |
| WO 96/35771 | 11/1996 | WIPO | C11D 3/12 |

*Primary Examiner*—Yogendra Gupta
*Assistant Examiner*—John M. Petruncio
*Attorney, Agent, or Firm*—Fish & Richardson P.C.

[57] ABSTRACT

The inventive compositions are pourable aqueous bleach composition which contain abrasives, suitable for use in cleaning hard surfaces such as are found, for example, in lavatories and kitchens. The compositions of the invention show good shelf life, exhibit a high level of bleach stability and show good stain and soil removal, particularly from hard surfaces.

26 Claims, No Drawings

POURABLE, THICKENED AQUEOUS BLEACH AND ABRASIVE CONTAINING COMPOSITIONS

This invention relates to a pourable aqueous bleach composition which contains abrasives, suitable for use in cleaning hard surfaces such as are found, for example, in lavatories and kitchens.

It is particularly difficult to produce aqueous bleach stable, thickened abrasive cleaning compositions which offer the simultaneous benefits of: good bleach stability which provides an acceptable shelf life for a product; acceptable viscosity characteristics; relatively low cost; and of course efficacy in removing stains and in effectively disinfecting surfaces, especially on inclined hard surfaces such is tiled, enameled and porcelain surfaces such as are typically associated with bathrooms or kitchens. While the art provides a number of such compositions directed to satisfying these requirements, these compositions have not uniformly met with success. The present invention overcomes may of these shortcomings in the prior art.

According to a first aspect the invention there is provided an aqueous thickened bleach compositions comprising:

a) alkali metal carboxylate, preferably a sodium salt thereof;

b) alkali metal salt, preferably an alkali metal chloride;

c) water dispersible nonionic amine oxide;

d) water dispersible anionic surfactant system including one or more sulfate or sulfonate surfactants, which system most preferably includes a minor amount of an alkyl diphenyl ether disulfonate surfactant;

e) available chlorine in a bleach releasing material, such as an alkali metal hypochlorite;

f) pH adjusting agent for maintaining the alkalinity of the composition;

g) an abrasive material, preferably a particulate abrasive material;

h) detergency builder; and, the balance being water to provide 100% wt.

A composition according to the invention is a stable, single phase, thickened bleach containing composition capable of adhering to vertical or inclined surfaces longer than thinner compositions. Such a composition is effective as an agent for stain and soil removal as well as disinfection. The high level of bleach stability and single solution phase behavior of the composition enables the composition to have an acceptable shelf life. The compositions exhibit little or no visibly discernible syneresis during its normal shelf life (6–9 months) and shelf life storage conditions (20° C.). In particularly preferred embodiments the compositions exhibit little or no syneresis under accelerated aging test conditions and at the same time exhibited good bleach stability. Such is particularly important for use and storage of the product in warm climate countries (South Africa, Brazil, etc.)

Compositions according to the invention are alkaline in character, desirably having a pH of about 12 or more, exhibit very favorable viscosity characteristics, are good hard surface cleaners and feature good bleach stability over time. The compositions may also include minor amounts, generally not more than at total of 5% wt., desirably less than 3% wt. of one or more optional constituents including ones which may improve the aesthetic appeal of the compositions, viz., perfumes and colorants. Such optional constituents should not undesirably affect the shelf stability or rheology of the compositions.

Preferably, the compositions according to the invention are aqueous thickened bleach compositions comprising in parts by weight (based on the total weight of the composition):

0.5–5.0 of an alkali metal carboxylate, preferably a sodium salt thereof;

0.5–4.0 of an alkali metal salt, preferably an alkali metal chloride;

0.05–5.0 of a water dispersible nonionic amine oxide;

0.1–8.0 of a water dispersible anionic surfactant system including one or more sulfate or sulfonate surfactants, which system most preferably includes a minor amount of an alkyl diphenyl ether disulfonate surfactant;

0.01–10.0 of available chlorine in a bleach releasing material, such as an alkali metal hypochlorite;

0.1–10.0 of an pH adjusting agent for maintaining the alkalinity of the composition;

1.0–50 of an abrasive material, preferably a particulate abrasive material;

0.05–3.0 of an detergency builder; and, the balance being water to provide 100% wt.

These preferred compositions exhibit the desirable theological and storage stable characteristics described above.

Compositions according to the invention include as an alkali metal carboxylate, such as sodium, lithium, or potassium carboxylates, preferably linear C8–C24 carboxylates. These are also frequently referred to as fatty acid soaps. Desirably these carboxylates include linear or branched alkyl chains, preferably linear, are at least 90%, more preferably at least 98% saturated, and most preferably are essentially completely (>99.5%) saturated. Typically, alkali metal carboxylates are commerically provided as technical grade mixtures which include various proportions of different alkyl chains within the such a mixture. Thus, the actual content and distribution of different alkyl chains may vary between such mixtures, as well as between suppliers of technical grade mixtures.

The inventors have surprisingly found that the selection of the alkali metal carboxylate constituent strongly influences the rheological characteristics of the compositions according to the invention being taught herein. The use of alkali metal carboxylates which have a significant fraction of C20, C22 and higher fatty acids leads excessive viscoelastic behavior which may be characterized by a long stringy flow in the final product. The use of alkali metal carboxylates which have an appreciable fraction of C14, C12 and lower fatty acids leads to excessive viscosity loss of the compositions. Thus, many presently commercially available art fatty acid carboxylate compositions, such as the technical grade mixtures mentioned previously are not necessarily suitable in the present inventive compositions.

Very preferably, as the alkali metal carboxylates are those which include at least 70% weight, preferably at least 75% wt., yet more preferably at least 80% wt. of C16 to C18 fatty acid carboxylates based on the total weight of the alkali metal carboxylate present in the compositions. At the same time, the compositions contain not more than 15% wt. of one or more C20, C22 and higher fatty acid carboxylates, and not more than % wt. of one or more C14, C12 and lower fatty acid carboxylates. Yet more preferably the alkali metal carboxylates are technical grade mixtures which include at least 65% weight of either the C16 fatty acid carboxylate or the C18 fatty acid carboxylate, and at the same time, also includes at least about 5% wt., preferably at least about 10% wt. of the other of the C16 or C18 fatty acid carboxylate. Most desirably, at least 65% of the alkali metal carboxylate constituent is a C18 fatty acid carboxylate and at the same time also contains at least 5% wt., preferably 5–10% wt. of a C16 fatty acid carboxylate. The remaining balance of the alkali metal carboxylate constituent may be one or more C20, C22 and higher fatty acid carboxylates and/or one or more C14, C12 and lower fatty acid carboxylates; desirably the total amounts of these recited materials are less than 20% wt., more preferably less than 15% wt. based on the total weight of the fatty acid carboxylates present in the inventive compositions. These carboxylates are preferably present as sodium salts of the corresponding carboxylates. The inventors have also surprisingly found that, although the alkali metal carboxylates very preferably comprise at least 80% wt. of C16 to C18 fatty acid carboxylates, and less than 20% wt. of fatty acids of higher or lower fatty acid carboxylates, the presence of both C16 and C18 fatty acid carboxylates are required. It has been surprisingly found that when such that the alkali metal carboxylate constituent does not include only a C16 alkali metal carboxylate to the exclusion of a C18 alkali metal carboxylate, or a C18 alkali metal carboxylate to the exclusion of a C16 alkali metal carboxylate. It is to be understood that with reference to the fatty acid carboxylate constituent, that such may consist substantially of only a C18 and C16 fatty acid carboxylate (or salt form thereof) wherein the C18 fatty acid carboxylate to C16 fatty acid carboxylate is present in a weight ratio of at least 4:1, preferably 5:1, and that the fatty acid carboxylate constituent contains less than 10% wt., preferably 7% wt. or less of other alkali metal carboxylates having higher or lower alkyl chain lengths.

The inventors have surprisingly and unexpectedly discovered that the overall characteristics of the compositions, particularly the rheological characteristics and the each of manufacture, markedly improve as the fatty acid carboxylate constituent increase in their C16 and C18 content as described above. However, it was found that where the fatty acid carboxylate constituent included a C16 fatty acid carboxylate without a C18 fatty acid carboxylate, the resultant composition exhibited poor initial viscosity and exhibited noticeable phase separation when allowed to stand overnight at room temperature. It was also found that where the fatty acid carboxylate constituent included a C18 fatty acid carboxylate without a C16 fatty acid carboxylate, the resultant composition exhibited particularly poor initial viscosity and exhibited significant syneresis when allowed to stand overnight at room temperature.

It has been found by the inventors that the use of alkali metal carboxylates within the preferred and most preferred weight range indicated above avoid the formation of an undesired amount of a filamentious network in the compositions. Such provides an undesirably high amount of viscoelastic behavior to the compositions which severely detracts from the delivery characteristics of the formulations from a consumer package, i.e., bottle.

Certain commercially technical grade mixtures of alkali metal carboxylates which satisfy available materials which fulfill the preferred weight range distributions are known, and are commercially available. However, a preponderance of technical grade mixtures of alkali metal carboxylates do not comprise a distribution of fatty acids within the preferred weight ranges, but this has been overcome by the inventors as well. In accordance with a specific and particularly preferred embodiment, the alkali metal carboxylate is provided as the resultant reaction product of a technical grade mixture of fatty acids having a particularly desirable distribution of alkyl chain lengths of the said fatty acids as described above, with a stochiometric excess of an appropriate material such as a caustic, i.e., an alkali metal hydroxide such as sodium hydroxide, in an aqueous medium. It is also contemplated that the technical grade mixture of fatty acids may be added to the composition of the invention as it is being formulated, wherein the acid groups of the fatty acids may react with an available co-reactant, such as available alkali metal hydroxide, and thus form the alkali metal carboxylate in situ.

Technical grade mixtures of fatty acids are frequently to be preferred as they often provide a more specific fatty acid distribution than many commercially available alkali metal carboxylate in a raw material form. Such fatty acids may be used to form the alkali metal carboxylate. According to certain particularly preferred embodiments the alkali metal carboxylate constituent is formed in situ, by reacting a fatty acid of appropriate alkyl chain length distribution with a further material, such as a caustic, in order to produce the alkali metal carboxylate constituent. One preferred technical grade mixture of fatty acids is: HYSTRENE 7018 (Humko Chem., a division of Witco Corp.) which is a technical grade mixture of fatty acids with the following weight distribution of alkyl chains: 2% wt. myrisitic acid, 0.5% wt. pentadecanoic acid, 30% palmitic acid, 2.6% margaric acid, and 65% stearic acid.

Further examples of useful alkali metal carboxylates useful in the present compositions according to the invention are illustrated in the examples.

The alkali metal carboxylate constituent is preferably present in an amount of preferably from 0.8–1.2% wt., and more preferably is present in an amount of about 1% wt., based on the total weight of the composition.

One or more alkali metal salts are included in the compositions of the invention as it has been observed that such materials favorably improve the thickening of the compositions. These may be added to the compositions separately, or they may form part of a different material which is used in the inventive compositions. For example, the alkali metal hypochlorites which are preferred for use in the invention are frequently supplied in commercial preparations which also include an amount of a salt, such as sodium chloride, which may satisfy the requirement for the presence of an alkali metal salt. The alkali metal salt may be selected from any number of water-soluble alkali metal salts and mixtures thereof, with the alkali metal preferably defined as lithium, potassium, or sodium, and the anion ion preferably defined as a halide (such as chloride, fluoride, bromide, iodide, and so on). More preferably, the alkali metal salt is selected from the group consisting of sodium chloride, lithium chloride, potassium chloride, and mixtures thereof with sodium chloride being most preferred in view of its ready availability and it's low cost. The alkali metal salt is preferably present in amount of 1.0–3.0% wt., more preferably from 1.5–2.5% wt, and most preferably about 2.0% wt. based on the total weight of the composition. It is to be understood that part or all of the alkali metal salts may be already included in, or be provided by, one or more of the other constituents used to form the inventive compositions. For example, the bleach releasing constituent may provide part or all of the alkali metal salt constituent.

The nonionic amine oxide of the compositions of the invention are preferably selected from:

A) Alkyl di (lower alkyl) amine oxides in which the alkyl group has about 10–20, and preferably 12–16 carbon atoms, and can be straight or branched chain, saturated or unsaturated, but are preferably saturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

B) Alkyl di (hydroxy lower alkyl) amine oxides in which the alkyl group has about 10–20, and preferably 12–16 carbon atoms, and can be straight or branched chain, saturated or unsaturated, but are preferably saturated. Examples are bis(2-hydroxyethyl) cocoamine oxide, bis (2-hydroxyethyl) tallowamine oxide; and bis(2-hydroxyethyl) stearylamine oxide;

C) Alkylamidopropyl di(lower alkyl) amine oxides in which the alkyl group has about 10–20, and preferably 12–16 carbon atoms, and can be straight or branched chain, saturated or unsaturated, but are preferably saturated. Examples are cocoamidopropyl dimethyl amine oxide and tallowamidopropyl dimethyl amine oxide; and D) Alkylmorpholine oxides in which the alkyl group has about 10–20, and preferably 12–16 carbon atoms, and can be straight or branched chain, saturated or unsaturated, but are preferably saturated.

Preferably the amine oxide constituent is an alkyl di (lower alkyl) amine oxide as denoted above and which may be represented by the following structure:

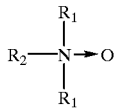

wherein each R1 independently is a straight chained C1–C4 alkyl group, preferably both R1 are methyl groups; and, R2 is a linear or branched C8–C18 saturated alkyl group, preferably is C10–C14 saturated alkyl group, most preferably is a C12 saturated alkyl group.

Each of the alkyl groups may be linear or branched, but most preferably are linear. The are preferably saturated, as such alkyl groups exhibit good performance in bleach containing compositions. Most preferably the amine oxide constituent is lauryl dimethyl amine oxide. Technical grade mixtures of two or more amine oxides may be used, wherein amine oxides of varying chains of the R2 group are present. Preferably, the amine oxides used in the present invention include R2 groups which comprise at least 50% wt., preferably at least 60% wt. of C12 alkyl groups and at least 25% wt. of C14 alkyl groups, with not more than 15% wt. of C16, C18 or higher alkyl groups as the R2 group.

The water dispersible amine oxide of the compositions of the invention is preferably present in an amount of from 0.1–1.0% wt., and more preferably is present in an amount of about 0.3–0.7% wt., based on the total weight of the composition.

The anionic surfactant system of the compositions of the invention includes one or more anionic sulfates and/or sulfonates selected from primary or secondary alkyl sulfates, alkyl ether sulfates, alkyl ether sulfonates, and preferably include a minor, but effective amount of one or more diphenyl disulfonates. Each of these materials are commercially available as surfactants and are frequently provided in a salt form in an aqueous carrier.

Exemplary useful anionic surfactants include those according to the formula:

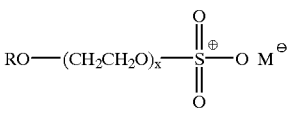

wherein

R is an alkyl chain having from about 8 to about 18 carbon atoms, which may be saturated or unsaturated, and where the longest linear portion of the alkyl chain is 15 carbon atoms or less on the average of the alkyl chain;

M is a counterion, such as an alkali metal, ammonium or substituted ammonium cation, and x is from 0 to 4.

Particularly preferred anionic surfactants include sodium lauryl sulfate, and sodium laureth sulfate.

Further useful anionic surfactants include secondary alkyl sulfates, especially those according to the general structure:

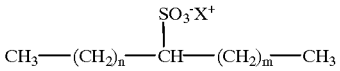

where:

n, m are each separately number of from 1–18 inclusive, and more desirably n and m are each selected such that n+m is a number of from 10–14 inclusive; and, X represents a counterion, desirably an alkali metal or ammonium counterion, yet more desirably is lithium, potassium or sodium, especially sodium.

There materials are commercially available under the trade name HOSTAPUR SAS from Höchst AG (Germany) of which various technical grade aqeuous mixtures are presently commercially available.

The inventors have surprisingly found that the inclusion of a minor, but effective amount of one or more alkyl diphenyl ether disulfonates as part of the anionic surfactant system very advantageously improves the rheological characteristics of the compositions subsequent to accelerated aging testing, which is a useful approximation of shelf life. At the same time the presence of these anionic compounds does not undesirably effect either the bleach stability of the compositions, and at least equally importantly do not undesirably solubilize the other constituents and thereby decrease the viscosity or thixotropic characteristics of the inventive compositions subsequent to such accelerated aging testing. In particularly preferred inventive compositions these alkyl diphenyl ether disulfonates are necessarily present.

Non-limiting examples of particularly useful alkyl diphenyl ether disulfonates are commercially available in anionic surfactant compositions from the Dow Chemical Co. under the trade designation DOWFAX, of which those which conform to the following general structure are particularly useful:

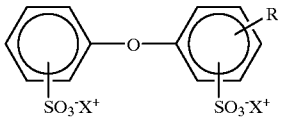

wherein:

X represents a counterion, desirably an alkali metal or ammonium counterion, yet more desirably is lithium, potassium or sodium, especially sodium, and, R represents a hydrophobic alkyl group, desirably a linear or branched C6–C16 alkyl group which may be straight chained or branched, may be optionally substituted but desirably are unsubstituted C6–C12 straight chained alpha olefins, or is tetrapropylene.

Of these, particularly useful are those available as DOWFAX 3B2 which is described as being a sodium salt according to the general structure depicted above and wherein R is a C6–C16 group derived from a C6–C10 olefin, preferably is group derived from a C10 olefin; and, DOWFAX 2A1 which is described as being a sodium salt according to the general structure depicted above and wherein R is derived from a C12 group.

The water dispersible anionic surfactant system is preferably present in an amount of from 0.5–1.5% wt., more preferably present in an amount of about 0.8–1.2% wt., and most preferably at about 1% wt. based on the total weight of the composition. These recited amounts include the alkyl diphenyl ether disulfonates which are preferably also present in the inventive compositions.

As the bleach releasing material, hypochlorites (such as alkali metal hypochlorites) as well as hypochlorite precursors may be used in the compositions according to the invention. Exemplary hypochlorite producing species, include halogen bleaches selected from the group consisting of the alkali metal and alkaline earth salts of hypohalite, haloimines, haloimides and haloamides. Representative hypochlorite producing compounds include sodium, potassium, lithium and calcium hypochlorite. A preferred material is sodium hypochlorite which is effective, and widely commercially available.

The available chlorine in a bleach releasing material of compositions according to the invention is preferably 0.1–3.5% wt., and more preferably 0.5–2.5% wt. based on the total weight of the compositions.

It is to be noted that frequently, commercially available hypochlorite containing materials from commercial sources include an appreciable amount of one or more further materials, particularly alkali metal salts (alkali metal chlorides) which further materials are among the required constituents according to the invention. The presence of such further materials it to be accounted for when producing the inventive compositions.

As the pH adjusting agent for maintaining the alkalinity of compositions according to the invention, an alkali metal hydroxide is the preferably used. It is to be understood however, that other known art pH buffers may be employed as long as the stability and viscosity of the composition are not adversely affected, inter alia, carbonate buffers. The alkali metal of the preferred hydroxide may be lithium, potassium, or sodium, and sodium hydroxide and potassium hydroxide are particularly useful pH stabilizers due to cost and availability, with sodium hydroxide most preferred. The alkali metal hydroxide is included in the composition in an effective amount to adjust the composition to a pH level of at least about 11, more preferably from 12 to 13.5, and most preferably within the range from 12.5 to 13.2.

The pH adjusting agent for maintaining the alkalinity of the composition is present in amounts of from 0.1–10.0% wt., more desirably from 0.2 –2.0% wt., and most desirably from 0.4–1.5% wt, and particularly desirably about 1.0% wt. based on the total weight of the composition.

The compositions according to the invention include abrasive material, preferably a particulate abrasive material such as any of a variety of dispersible particulate solids including but not limited to inorganic materials such as carbonate salts including poorly water soluble alkali metal carbonates particularly calcium carbonate; calcite, dolomite, feldspar, diatomaceous earth, talc, bentonite, pumice, alumina trihydrate, silica and, various oxides such as aluminum and titanium oxides. Other abrasive materials based on organic polymers may also find use in the inventive compositions, especially those in finely comminuted or particulate form. Such materials may be used singly or in combination. Desirably these abrasive materials are bleach stable, comminuted materials, with an average particle diameter falling within the range of from about 0.1–500 micrometers, more desirably fall within the range of from about 1–50 micrometers, and most desirably fall within the range of from about 5 to about 15 micrometers.

The abrasive material is preferably present in an amount of from 5.0–40% wt., more preferably from 8.0–35% wt, and most preferably is present in an about of 8.0–16% wt. based on the total weight of the composition.

The inventive compositions according to the invention include a minor but effective amount of a detergency builder constituent. Examples of such materials include known detergency builders which are compatible in the bleach containing composition according to the invention. Desirably the detergency builder constituent is one or more inorganic compounds such as alkali metal carbonates (including without limitation carbonates, bicarbonates, sesquicarbonates), phosphates and polyphosphates (including without limitation tripolyphospates, pyrophosphates, and sodium dihydrogenphosphate) as well as silicates (including without limitation metasilicates, orthosilicates, and sodium silicate). Such materials may be hydrous or anhydrous. More specific and preferred examples include sodium tripolyphosphate, sodium dihydrogenphosphate, sodium sulfate, sodium carbonate, potassium carbonate, sodium polyphosphate, potassium pyrophosphate, potassium tripolyphosphate, and sodium hexametaphosphate.

These materials may be used singly, or in mixtures, and may also be used in conjunction with sequestrants such as organic builder salts. By way of non-limiting example such include low molecular weight polyacrylic acids typically having molecular weight of from 2000–50,000, alkali metal polycarboxylates including water-soluble citrates such as sodium and potassium citrate, sodium and potassium tartarate, sodium and potassium ethylenediaminetetraacetate, sodium and potassium N-(2-hydroxyethyl)-ethylene diamine triacetates, sodium and potassium nitrilo triacetates, as well as sodium and potassium tartrate mono- and di-succinates. As noted, these organic builder salts may be used individually, as a combination of two or more organic builder salts, as well as in conjunction with one or more detergency builders, including those indicated above. Before being used in the inventive compositions however, these organic builder salts should first be evaluated in order to determine any undesirable reactivity with the bleach in the inventive compositions.

Most desirably, the detergency builder constituent is a minor amount of an alkali metal metasilicate or alkali metal orthosilicate, especially sodium metasilicate is present as a detergent builder constituent in the inventive compositions, as it has been observed by the inventors that such are effective and do not deleteriously effect the bleach stability or viscous characteristics of the inventive compositions described herein.

The detergency builder constituent is preferably present in an amount of from 0.1–4.0% wt., more preferably from 0.5–2.5% wt, and most preferably in an about of 1–1.5% wt. based on the total weight of the composition according to the invention.

In certain preferred embodiments, the inventive compositions according to the invention are substantially free of phosphates and phosphate containing materials, as such materials are undesirable from an environmental standpoint.

The individual constituents described above are available from a variety of commercial suppliers, often as technical grade mixtures of the recited compounds, which are frequently provided in a salt form, and are typically supplied in a liquid carrier such as water and/or an organic solvent.

The compositions of the invention are viscous in nature, and desirably exhibit a viscosity of between about 500 and 4000 cps, and more desirably from 700 to 2000 cps at a temperature of 25° C. as measured using a Brookfield RVT viscometer at a speed of 50 rpm. It is to be noted that the viscosity of a newly made composition is frequently less viscous than subsequent to aging, and that the compositions may exhibit thickening upon standing or storage over extended periods of time, such as 3–6 months. Such thickening however is not considered to be deleterious to the overall performance of the composition, as it has also been observed that the composition taken on thixotropic characteristics and may be easily rendered flowable by simply agitating the composition, such as by briefly shaking the container containing the composition.

The compositions according to the invention most desirably include no further additional thickener constituents, and such as colloidal thickeners, particularly colloidal aluminium oxides, polyacrylate compounds such as Carbopol® compositions (ex. B.F.Goodrich Co.), natural or synthetic clays (i.e., laponite clay) gums or cellulose based thickeners.

The compositions according to the invention also exhibit excellent synerersis characteristics as exhibiting almost no separation of the constituents, even on long term standing, particularly under the accelerated aging test conditions outlined below.

Compositions of the invention are not only viscous, but also exhibit excellent shelf-life both in terms of retardation of alkali metal hypochlorite degradation and single solution phase behavior. The alkali metal hypochlorite degradation has been slowed to render a composition having an alkali metal hypochlorite half-life of at least about 30 days, more preferably at least three months and most preferably at least six months. Hypochlorite degradation may be measured by alkali metal hypochlorite titration over time (which may be accomplished by numerous techniques known to those skilled in the art). Observation of the single solution phase behavior of the composition may be made visually. The high level of stability combined with the high level of viscosity provides for a commercially desirable composition useful as a multi-purpose cleaning composition.

A particularly preferred embodiment of the invention is an aqueous thickened bleach containing compositions having a pH of 12 or greater which comprises, (preferably consists essentially of), in parts by weight (based on the total weight of the composition):

a) 0.5–5.0 of an alkali metal carboxylate which comprises alkali metal salts of comprising at least 75% wt. of C16 to C18 fatty acid carboxylates, not more than 15% wt. of one or more C20, C22 and higher fatty acid carboxylates, and not more than 15% wt. of one or more C14, C12 and lower fatty acid carboxylates based on the total weight of the alkali metal carboxylate present in the compositions;

b) 0.5–4.0 of an alkali metal salt, preferably an alkali metal chloride;

c) 0.05–5.0 of a water dispersible nonionic amine oxide;

d) 0.1–8.0 of a water dispersible anionic surfactant system including one or more sulfate or sulfonate surfactants, which system also includes a minor amount of an alkyl diphenyl ether disulfonate surfactant;

e) 0.01–10.0 of available chlorine in a bleach releasing material, such as an alkali metal hypochlorite;

f) 0.1–10.0 of an pH adjusting agent for maintaining the alkalinity of the composition;

g) 1.0–50 of an abrasive material, preferably a particulate abrasive material;

h) 0.1–4.0 of a detergency builder;

i) 0–5% of one or more optional constituents; and, the balance being water to provide 100% wt. of the compositions.

Such compositions may be characterized by very favorable viscosity characteristics, good bleach stability over time, and most preferably are substantially free of further thickener components such as colloidal aluminum oxides, gums and cellulose based thickeners.

The viscosity characteristic of the composition makes it particularly well-suited for use as a hard surface cleaner and disinfectant, such as, a bathroom cleaner, a toilet bowl cleaner, a mold and mildew cleaner, a laundry additive, and so on. Additional optional ingredients include suitable hypochlorite-stable colorants, perfumes, perfume blends, and so on, as known to those skilled in the art.

Any number of techniques may be employed to prepare the compositions of the of the invention, as within the knowledge of one skilled in the art.

The compositions according to the invention are desirably produced utilizing a stirrer which ensures that a homogenous composition is produced. One such mixing device includes a conventional variable speed, electrically operated stirrer equipped with a standard mixing propeller. A preferred mixing device is a Cowles blade. Such a Cowles blade desirably includes a surface coating which does not undesirably react with any of the constituents used to form the inventive compositions. It is important that during the production of the compositions that the uptake of air into the compositions be avoided as an undesirable reduction in the final density of the composition will occur. At the same time, excessive speed of the mixing propeller, or Cowles blade may also destroy the development of the thickening system of the composition as they are being formed.

While the order of the addition of the constituents may vary, preferably the order of addition of the various constituents is as described below with reference to the examples. In accordance with preferred embodiments of the invention, the compositions are produced in accordance with one of the methods outlined below. It has been observed that the order of addition of the constituents, and the processing conditions are important in order to produce a composition having the desired characteristics discussed above.

An exemplary process for producing the inventive compositions according to the invention is as follows. A first preblend mixture is made by adding about 6–8% of the deionized water at 30–35° C. to a clean glass beaker and with moderate stirring, adding in the sodium chloride or other salt (potassium salt) for a sufficient time in order to dissolve the same. A second preblend mixture is made by adding about 6–8% of the deionized water at 30–35° C. to a further clean glass beaker, adding in the sodium metasilicate and providing moderate stirring for a sufficient time in order to dissolve the same. Both the first and the second preblend mixture are allowed to cool to 30° C. or less.

A primary mixture is formed by adding about 65–85% of the deionized water to a clean glass beaker, which is heated to 75–80° C. Under moderate stirring, and with the maintenance of the temperature at 75–80° C. about one-third of the total amount of sodium hydroxide is added until dissolved. Afterwards, the fatty acid carboxylic acid (HYSTRENE 7018) is added, and mixing continued until full solubilization was attained. It is to be noted that where a fatty acid carboxylate salt is utilized, it is added instead of the sodium hydroxide and the fatty acid carboxylic acid recited immediately above, and stirred until dissolved in the deionized water. Next is added the amine oxide constituent, and again stirring continued until solubilization was reached. Subsequently the secondary alkyl sulfonate was added to the mixture again stirring continued until solubilization was reached. Next the ether sulfate constituent was added, while stirring continued until solubilization was reached. Subsequently the diphenyl disulfonate constituent was added and stirring continued until solubilization was reached. Stirring during the process steps above was at a moderate speed, sufficient to provide good mixing, but not excessive to avoid entrainment of excess air into the mixture. Next, the first preblend mixture was added under moderate stirring conditions to ensure that a uniform mixture was formed. The resulting primary mixture was removed from the heat source and allowed to cool to 25–30° C.

A third preblend mixture was formed by adding 6–8% of the deionized water at 20–30° C. to a third beaker, and under moderate stirring conditions, the calcium carbonate was uniformly dispersed. To another glass beaker under moderate stirring conditions was added any remaining deionized water, the hypochlorite constituent, the remaining sodium hydroxide (or other, i.e., potassium salt) and the second preblend mixture. The contents of these two glass beakers were then combined, under moderate stirring to ensure homogeneous mixing of the constituents.

Thereafter, this third preblend mixture was added to the primary mixture under adequate stirring conditions to ensure the formation of a uniform composition. It is noted that when the third preblend mixture was added to the primary mixture, that a thickening of the stirring primary mixture was observed. This was compensated for by increasing the rotational speed of the mixing blade (either a conventional propeller, a conventional flat bladed blade or a Cowles blade) while this thickening was observed, afterwards slowly decreasing the rotational speed as the apparent viscosity of the primary mixture decreased. Subsequently any optional constituents, such as fragrances, etc. are added and mixing continued under moderate stirring conditions for 10–30 minutes to ensure the formation of a uniformly mixed product.

It is to be understood that the various named constituents indicated above may be substituted by or used with other similar constituents identified in this specification.

The invention is further illustrated in the following Examples in which weight percentages are by total weight of the final composition unless otherwise indicated. Certain most preferred embodiments of the invention are indicated in one or more of the Examples.

EXAMPLES

Certain formulations according to the invention are listed in Table 1, and the order of producing the compositions are described below. The constituents indicated on Table 1, are the respective actives weights as supplied "as supplied" of the indicated constituent. The commercial source, and weight percentage of actives in the "as supplied" constituent is indicated on Table 2, following. The source of the constituents denoted on Table 1, is described and detailed in Table 2. Where no weight percentage of actives indicated in Table 2, it is presumed that the constituent is comprised of "100% wt." actives.

TABLE 1

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 |
|---|---|---|---|---|---|---|---|---|---|---|---|---|
| fatty acid carboxylate(1) | 1.25 | 1.00 | 1.25 | 1.00 | 1.00 | — | — | — | — | 0.825 | 0.275 | 0.55 |
| fatty acid carboxylate(2) | — | — | — | — | — | 1.10 | 1.00 | 1.10 | 1.05 | 0.275 | 0.825 | 0.55 |
| lauryl dimethyl amine oxide (30%) | 2.50 | 1.50 | 2.50 | 1.50 | 1.50 | 1.50 | 1.50 | 1.50 | 1.2(3) | 1.50 | 1.50 | 1.50 |
| sodium lauryl ether sulfate | — | 1.50 | 1.25 | — | 1.50 | 1.00 | 1.00 | 1.50 | 2.0(4) | 1.5 | 1.5 | 1.5 |
| sodium lauryl sulfate | 1.25 | — | — | 1.50 | — | — | — | — | — | — | — | — |
| sodium sulfate | 0.25 | — | — | — | — | — | — | — | — | — | — | — |
| secondary alkyl sulfonate | — | 1.00 | 0.25 | 1.00 | 1.00 | 1.00 | 1.00 | 1.00 | 1.00 | 1.00 | 1.00 | 1.00 |
| diphenyl disulfonate | — | — | 0.10 | 0.10 | 0.10 | 0.10 | 0.10 | — | — | 0.10 | 0.10 | 0.10 |
| sodium chloride | 0.75 | 0.75 | 0.75 | 0.75 | 0.75 | 0.75 | 0.75 | 0.75 | 1.00 | 0.75 | 0.75 | 0.75 |
| sodium metasilicate | 1.00 | 1.00 | 1.00 | 1.00 | 1.00 | 1.50 | 1.50 | 1.00 | 1.50 | 1.50 | 1.50 | 1.50 |
| sodium hydroxide | 0.50 | 0.50 | 0.50 | 0.50 | 0.50 | 1.00 | 1.00 | 1.00 | 1.00 | 1.28 | 1.28 | 1.28 |
| calcium carbonate | 12.00 | 12.00 | 12.00 | 15.00 | 0.50 | 15.00 | 15.00 | 15.00 | 15.00 | 15.00 | 15.00 | 15.00 |
| sodium hypochlorite | 20.00 | 20.00 | 20.00 | 20.00 | 20.00 | 10.30 | 10.30 | 10.30 | 10.30 | 10.30 | 10.30 | 10.30 |
| perfume | 0.01 | 0.01 | 0.01 | 0.07 | 0.07 | — | — | — | — | 0.07 | 0.07 | 0.07 |
| deionized water | q.s. | q.s. | q.s. | q.s. | q.s. | q.s. | q.s. | q.s. | q.s. | q.s. | q.s. | q.s. |

(3) in Ex. 9, a decyl dimethyl amine oxide was used, BARLOX 10 (Lonza Corp., Fairlawn, NJ) (30% wt. actives)

(4) in Ex. 9, a sodium lauryl ether sulfate, STANDAPOL ES-1 (28% wt. actives), having an average of 1 ethoxy group per lauryl chain (Henkel Corp., Gulph Mills, PA)

TABLE 2

| Name | source |
|---|---|
| fatty acid carboxylate(1) | the sodium salt of a mixture of fatty acids having a distribution of 2.9% wt. C14, 28.6% wt. C16, 63.7% wt. C18, 1.6% wt. C20 fatty acids, 3.2% wt. other fatty acids (Chemserve Fine Chemicals, Johannesburg South Africa) |
| fatty acid carboxylate(2) | reaction product of a stoichiometric excess of sodium hydroxide in an aqueous medium and HYSTRENE 7018 (Witco Corp.), indicated by its supplier to be a technical grade mixture of fatty acids having a distribution of 2% wt. C14, 30% wt. C16, 65% wt. C18, and 3% wt. other fatty acids, with a which formed the sodium salts of the fatty acids |

TABLE 2-continued

| Name | source |
|---|---|
| fatty acid carboxylate(3) | reaction product of a stoichiometric excess of sodium hydroxide in an aqueous medium and HYSTRENE 9718 (Witco Corp.) indicated by its supplier to be a technical grade mixture fatty acids containing at least 90% wt. of C18 fatty acid, which formed the sodium salts of the fatty acids |
| fatty acid carboxylate(4) | reaction product of a stoichiometric excess of sodium hydroxide in an aqueous medium and HYSTRENE 9016 (Witco Corp.) indicated by its supplier to be a technical grade mixture fatty acids containing at least 90% wt. of C16 fatty acid, which formed the sodium salts of the fatty acids |
| lauryl dimethyl amine oxide | EMPIGEN OB (30% wt. actives) (Albright & Wilson Co.) or, in Ex. 6–12 was AMMONYX LO (30% wt. actives) (Stepan Corp.) |
| sodium lauryl ether sulfate | EMPICOL ESB3 (28% wt. actives) (Albright & Wilson Co.) or in Ex. 6–12 was STANDAPOL ES2 or STANDAPOL ES1 (26–28% wt. actives) (Henkel Corp.) |
| sodium lauryl sulfate | EMPICOL LX28R (28% wt. actives) (Albright & Witson Co.) |
| sodium sulfate | anhydrous sodium sulfate |
| secondary alkyl sulfonate | HOSTAPUR SAS 60 (60% wt. actives) (Hoechst AG) |
| diphenyl disulfonate | an alkyl diphenyl ether disulfonate (45% wt. actives) DOWFAX 3B2 (Dow Chemical Co.), or POLYTERGENT 3B2 (45% wt. actives) (Olin Corp.) |
| sodium chloride | anhydrous sodium chloride |
| sodium metasilicate | anhydrous sodium metasilicate |
| sodium hydroxide | anhydrous, in pellet or in powder form |
| calcium carbonate | average particle size, 15 microns; KULUBRITE 15 (G & W Co. (South Africa)), or in Ex. 6–12, avg. particle size, 15–20 microns; MARBLEWHITE 200 (Whittaker, Clark & Daniels Co.) |
| sodium hypochlorite | aqueous dilution of sodium hypochlorite (7.5% wt. actives)(NCP Chlorchem (South Africa)) or in Ex. 6–12, (14.6% wt. actives) (Kuehne Chem. Co.) |
| perfume | proprietary composition of its manufacturer |
| deionized water | deionized water |

Each of the compositions according to the examples of Table 1 were produced generally in accordance with the following protocol:

First, approximately 60% of the total water used to make the formulation was heated o within a few degrees above 80° C. and poured into a clean 2 liter beaker. Next, a variable peed, electrically operated stirrer equipped with a coated Cowles blade was placed in the water and stirring was initiated. The speed of blade rotation was set at a slow speed (approx. 150–200 rpm). Next the sodium stearate was slowly added in a dropwise or slow stream manner such that undue aeration/foam formation and partial solubilization was minimized. The temperature was maintained at about 75–80° C. during and after the addition of the stearate, and stirring continued until the sodium stearate completely dissolved or melted. During the production of the composition, the formation of a vortex about the rotating shaft of the electrically operated stirrer was avoided by adjusting the rotational speed. Such ensured that minimum air uptake into the composition occurred. At the same time, sufficient agitation was maintained in order to ensure that thorough and homogenous mixing of the compositions occurred, without high shear.

Thereafter, the lauryl dimethyl amine oxide was added by slowly pouring it into the beaker. Stirring continued at the same speed as before, and continued until the solution was homogeneous. Next, each of the anionic surfactant constituents were added individually, pausing between each addition for sufficient time such that the mixture became homogenous. Generally subsequent to the addition of the anionic surfactants the mixture appeared to be translucent or opaque.

The remaining volume of water was dispensed into a separate small beaker. To the beaker, the sodium chloride was added and mixed using a further electrically operated stirrer until the sodium chloride was fully dissolved. Thereafter this solution was slowly poured into the two liter beaker and the mixing continued until a homogenous mixture was once again formed. It was observed that due to this addition, thickening of the mixture occurs and an increase in the rotational speed of the Cowles blade may be made in order to maintain the initial agitational requirement. While stirring continued, the contents of the beaker were allowed to cool to within a few degrees below 30° C. During this cooling process care should was taken to monitor, and if necessary, adjustments were made to the rotational speed of the Cowles blade such that the breakup of the filamentous network formed during the cooling process was avoided.

In a further clean beaker, the sodium hypochlorite, sodium hydroxide and sodium metasilicate are mixed to homogeneity. After the contents of the 2 liter beaker were sufficiently cooled as above the mixture of the sodium hypochlorite, sodium hydroxide and sodium metasilicate were added thereto while stirring continuted. At this point, a further thickening of the mixture was observed and again, if necessary the rotational speed of the Cowles blade was adjusted to avoid the breakup of the filamentious network formed. At the same time, care was taken to maintain the temperature of the composition to avoid crystallization of the anionic soap, and its precipitation from the mixture. Stirring of the mixture was maintained to ensure homogeneity thereof, typically for a period of approximately 20 mintutes. Thereafter, the abrasive material was slowly added to the mixture and the speed of the Cowles blade was increased by approximately 75–100%, and thereafter was returned to the prior rotational speed which had been set just prior to the addition of the abrasive material. The mixture was stirred to homogeneity, after which the stirrer was deactivated and removed. The resulting compositions were thickened mixtures which were homogenous in appearance, and smooth in texture.

Evaluation of Chlorine Stability:

Certain of the exemplary compositions of Table 1 were evaluated for chlorine stability under accelerated aging conditions over a period of weeks. In the test, the initial available chlorine content was determined by % $Cl_2$ by the sodium thiosulfate method, and again determined at periodic intervals over the duration of the test. The samples of the compositions were maintained at elevated temperatures of 40° C. for a ten week period, and testing was performed at weekly intervals. The following Table 3 lists the average available chlorine readings over the duration of the test.

TABLE 3

| | Example 1 |
|---|---|
| Initial | 1.71 |
| 1 week | 1.61 |
| 2 weeks | 1.57 |
| 3 weeks | 1.48 |
| 4 weeks | 1.39 |
| 5 weeks | 1.36 |
| 6 weeks | 1.31 |
| 7 weeks | 1.28 |
| 8 weeks | 1.24 |
| 9 weeks | 1.17 |
| 10 weeks | 1.15 |
| net % loss of available chlorine | −32% |

As may be seen from the results of Table 3, the compositions exhibited excellent retention of available chlorine over the duration of the accelerated aging test.

It was observed that during the harsh conditions of the accelerated aging test, the composition according to Example 1 exhibited no synerersis until the fifth week of the test. At the tenth week of the test, the observed syneresis was minor, being only 8 mm of a separate phase in a total column height of 200 mm, i.e., about 4% of the total volume of the composition.

The accelerated aging test was also performed for Examples 1, 2 and 3 of Table 1 and these samples also exhibited no syneresis until the fifth week of the test.

Certain comparative examples, which demonstrated the behavior of compositions which included either C16 or C18 fatty acid carboxylates in the fatty acid carboxylate constituent were produced generally in the manner outlined above. These formulations, indicating the "as supplied" weights of the identified constituents were as follows:

TABLE 4

| | Comp. 1 | Comp. 2 |
|---|---|---|
| fatty acid carboxylate(3) | 1.10 | — |
| fatty acid carboxylate(4) | — | 1.00 |
| lauryl dimethyl amine oxide | 1.50 | 1.50 |
| sodium lauryl ether sulfate | 1.00 | 1.00 |
| sodium lauryl sulfate | — | — |
| sodium sulfate | — | — |
| secondary alkyl sulfonate | 1.00 | 1.00 |
| diphenyl disulfonate | 0.10 | 0.10 |
| sodium chloride | 0.75 | 0.75 |
| sodium metasilicate | 1.50 | 1.50 |
| sodium hydroxide | 15.00 | 15.00 |
| calcium carbonate | 1.00 | 1.00 |
| sodium hypochlorite | 10.30 | 10.30 |
| perfume | — | — |
| deionized water | q.s. | q.s. |

In the comparative compositions, "Comp.1" and "Comp.2" were produced of the same constituents identified in Table 2, above. The viscosity behavior of certain compositions according to the invention, and of he comparative examples was evaluated using a Brookfield RVT viscometer using the spindle indicated by the apparatus at a rotational speed of 50 rpm. The valued reported on Table 5 indicate the initial "as mixed" composition, and the viscosity (in cp) of samples after 14 or 17 days of aging at room temperature (20° C.) and aging at 49° C.; compositions Comp.1 and Comp.2 were aged at these temperatures for 17 days, Ex. 10, Ex. 11 and Ex. 12 were aged for 14 days. It is understood that 1 cp is equivalent to 1 Pascal•second.

TABLE 5

| formulation: | Comp. 1 | Comp. 2 | Ex. 10 | Ex. 11 | Ex. 12 |
|---|---|---|---|---|---|
| "as mixed" | 680 | 1460 | 2280 | 2620 | 1780 |
| 20° C. aged | 900 | 2040 | 2320 | 2720 | 1400 |
| 49° C. aged | 3240 | 2600 | 2580 | 4600 | 1200 |

As may be seen, the formulation according to Comp. 1 and 2 exhibited reduced initial viscosity, generally lower than preferred initial viscosity values. The composition of Comp. 1 also exhibited poor viscosity values upon 17 days at room temperature.

The same formulations indicated on Table 5 were also observed with respect to syneresis after being allowed to stand at room temperature overnight after their initial mixing. The formulation according to Comp. 1 was observed to have phase separated into two distinct layers. The formulation according to Comp. 2 was observed to also have separated into two layers, somewhat less distinct that the formulation of Comp. 1. In contrast, each of the examples according to the invention, Ex. 10 through Ex. 12 exhibited no visible syneresis during this same time interval.

Pilot-plant batch production:

A scaled-up amount of the composition according to the invention was formed, the composition of which was in accordance with the following:

TABLE 6

| PILOT PLANT BATCH | |
|---|---|
| sodium stearate | 1.50 |
| Ammonyx LO (30%) | 2.25 |
| Hostapur SAS 60 | 1.50 |
| Standapol ES2 (25%) | 2.25 |
| PolyTergent 3B2 | 0.15 |
| sodium chloride | 1.122 |
| sodium metasilicate | 1.50 |
| sodium hydroxide (50%) | 1.50 |
| calcium carbonate | 22.5 |
| sodium hypochlorite (16%) | 14.0 |
| perfume | 0.10 |
| deionized water | q.s. |

The amounts on Table 6 given indicate pounds (lbs.) of the named constituent which was used 'as supplied' form the respective supplier. The parenthesis following the named constituent indicate the percent of "actives" contained within the respective composition. The identity of the constituents are indicated on Table 2. The total amount of the batch was based on 150 lbs., which was 18 gallons of the final product.

As a primary mixing vessel, there is used a 30 gallon stainless steel jacketed mixing vessel. The jacket is provided With steam as a heat source or alternately with cold water as a coolant fluid. The interior of the vessel was stainless steel and included two diametrically opposed mixing baffles extending approximately 2 inches inwardly from the interior wall of the mixing vessel. These were vertical plates. For agitating the contents of the primary mixing vessel was provided a Lighten'® mixer supplied with a mixing shaft on which were mounted two 10 inch diameter three-bladed hydrofoil type propellers. The propellers were coated and the first propeller was mounted at the bottom of the mixing shaft, and approximately 8 inches upwardly up the shaft was mounted the second propeller.

Also used was a pre-mix vessel which was essentially a polymeric bucket which was used to form the carbonate pre-mix composition.

First, the carbonate pre-mix composition was formed to an aliquot of a total amount of water indicated on Table 6 to which was added 22.5 pounds of calcium carbonate. This was mixed utilizing a hand-held portable mixer provided with a standard 3 inch bladed propeller on a mixing shaft. The water and calcium carbonate mixture was allowed to mix for approximately 45–50 minutes until a uniform mixture is produced. The water was at room temperature (approximately 68° F., 20° C.).

To the primary mixing vessel was charged the remaining amount of water which was supplied at room temperature. The Lighten'® mixer was engaged so that the propeller assembly rotated at 130 rpm. Steam was supplied to the jacket side of the primary mixing vessel. Heating continued until the water reached approximately 176° F. (80° C.) where it was maintained for five minutes under moderate mixing conditions.

To the primary mixing vessel was added the sodium stearate which was allowed to homogeneously mix for seven minutes to ensure that it was dissolved. Thereafter, the amine oxide constituent was allowed and allowed to mix homogeneously mix for five minutes. Thereafter, the secondary alkyl sulfonate was added and allowed to mix for five minutes to ensure homogeneity. Thereafter added to the tank in sequential order was said lauryl ether sulfate followed by the diphenyl disulfonate and again, the composition was allowed to mix to ensure homogeneity. In all the preceding steps, the rotational speed of the propellers was maintained at 130 rpm, the temperature of the composition in the primary mixing vessel was maintained in the range of 170–180° F.

The next step, sodium chloride was added at a relatively slow rate. This was done in order to ensure good mixing, and also that the build up of viscosity of the composition was not excessively rapid. The addition of the sodium chloride took approximately 1–2 minutes, and thereafter the composition was allowed to mix for five minutes to ensure homogeneity of the mixture. Immediately thereafter, cold water was applied to the jacket side of the primary mixing vessel so to cool the mixture therein. Over a 22-minute time period, the temperature of the composition fell from approximately 175° F. to approximately 86° F. At the same time, the rotational speed of the Lightening® mixer was approximately 150 rpm at the conclusion of the cooling step.

Thereafter, the sodium hypochlorite, sodium hydroxide (50% solution) and a sodium metasilicate were added to the stirring contents of the primary active vessel and allowed to mix homogeneously.

The addition of these materials occurred over a four-minute period. Thereafter, for subsequent 20 minutes the rotational speed of the propellers was raised to 250 rpm and the composition was allowed to stir homogeneity. It is to be observed that only a very slight vortex was observed to form around a color shaft and as has been noted previously this ensured that a minimum amount of air was entrained or "taken up" into the stirring composition. At the same time the speed was not excessive, i.e., did not break down the thickening composition by being of excessively high sheer.

Thereafter was added over a 20-minute period an aqueous calcium carbonate mixture produced previously. This was done at a relatively slow rate in order to ensure that good mixing of the calcium carbonate into the composition would result. Also, the fragrance constituent was also added.

Thereafter, the composition was allowed to mix for 45 minutes in order to ensure ultimate homogeneity after which the mixer was stopped, and the product was removed from the primary mixing vessel.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

We claim:

1. An aqueous thickened bleach composition comprising:

a) alkali metal carboxylate which comprises at least 75% wt. of C16 to C18 fatty acid carboxylates, not more than 15% wt. of one or more C20, C22 and higher fatty acid carboxylates, and not more than 15% wt. of one or more C14, C12 and lower fatty acid carboxylates based on the total weight of the alkali metal carboxylate present in the compositions;

b) alkali metal salt;

c) water dispersible nonionic amine oxide;

d) water dispersible anionic surfactant system including one or more sulfate or sulfonate surfactants;

e) an alkali metal or alkaline earth metal hypochlorite;

f) pH adjusting agent;

g) a particulate abrasive material;

h) a detergency builder; and, water to provide 100% wt.

2. An aqueous thickened bleach composition according to claim 1 wherein the alkali metal carboxylate constituent comprises at least 65% wt. of a C18 fatty acid carboxylate and at the same time also contains at least 5% wt. of a C16 fatty acid carboxylate.

3. An aqueous thickened bleach composition according to claim 2 wherein the alkali metal carboxylate constituent comprises at least 65% wt. of a C18 fatty acid carboxylate and at the same time also contains 5–10% wt. of a C16 fatty acid carboxylate.

4. An aqueous thickened bleach composition according to claim 2 wherein the alkali metal carboxylate constituent comprises at least 65% wt. of a C18 fatty acid carboxylate and at the same time also contains 5–10% wt. of a C16 fatty acid carboxylate.

5. An aqueous thickened bleach composition according to claim 1 wherein the alkali metal carboxylate constituent comprises a C18 and a C16 fatty acid carboxylate wherein the C18 fatty acid carboxylate to C16 fatty acid carboxylate is present in a weight ratio of at least 4:1, and that the fatty acid carboxylate constituent contains less than 10% wt. of other alkali metal carboxylates having higher or lower alkyl chain lengths.

6. An aqueous thickened bleach composition according to claim 1 wherein the alkali metal carboxylate constituent comprises a C18 and a C16 fatty acid carboxylate wherein the C18 fatty acid carboxylate to C16 fatty acid carboxylate is present in a weight ratio of at least 5:1, and that the fatty acid carboxylate constituent contains less than 10% wt. of other alkali metal carboxylates having higher or lower alkyl chain lengths.

7. An aqueous thickened bleach composition according to claim 1 wherein the alkali metal carboxylate constituent comprises a C18 and a C16 fatty acid carboxylate wherein the C18 fatty acid carboxylate to C16 fatty acid carboxylate is present in a weight ratio of at least 4:1, and that the fatty acid carboxylate constituent contains less than 7% wt. of other alkali metal carboxylates having higher or lower alkyl chain lengths.

8. A composition according to claim 1 which is substantially phosphate free.

9. A composition according to claim 1 which is substantially free of further thickener constituents.

10. An aqueous thickened bleach composition according to claim 1 comprising in parts by weight based on the total weight of the composition:

0.5–5.0 of an alkali metal carboxylate 0.5–4.0 of an alkali metal chloride;

0.05–5.0 of a water dispersible nonionic amine oxide;

0.1–8.0 of a water dispersible anionic surfactant system including one or more sulfate or sulfonate surfactants;

0.01–10.0 an alkali metal or alkaline earth metal hypochlorite;

0.1–10.0 of an pH adjusting agent;

1.0–50 of a particulate abrasive material;

0.05–3.0 of a detergency builder; and, to 100% wt., water.

11. An aqueous thickened bleach composition according to claim 10 wherein the alkali metal carboxylate constituent comprises at least 65% wt. of a C18 fatty acid carboxylate and at the same time also contains at least 5% wt. of a C16 fatty acid carboxylate.

12. An aqueous thickened bleach composition according to claim 11 wherein the alkali metal carboxylate constituent comprises at least 65% wt. of a C18 fatty acid carboxylate and at the same time also contains 5–10% wt. of a C16 fatty acid carboxylate.

13. An aqueous thickened bleach composition according to claim 11 wherein the alkali metal carboxylate constituent comprises at least 65% wt. of a C18 fatty acid carboxylate and at the same time also contains 5–10% wt. of a C16 fatty acid carboxylate.

14. An aqueous thickened bleach composition according to claim 11 wherein the alkali metal carboxylate constituent comprises a C18 and a C16 fatty acid carboxylate wherein the C18 fatty acid carboxylate to C16 fatty acid carboxylate is present in a weight ratio of at least 4:1, and that the fatty acid carboxylate constituent contains less than 10% wt. of other alkali metal carboxylates having higher or lower alkyl chain lengths.

15. An aqueous thickened bleach composition according to claim 11 wherein the alkali metal carboxylate constituent comprises a C18 and a C16 fatty acid carboxylate wherein the C18 fatty acid carboxylate to C16 fatty acid carboxylate is present in a weight ratio of at least 5:1, and that the fatty acid carboxylate constituent contains less than 10% wt. of other alkali metal carboxylates having higher or lower alkyl chain lengths.

16. An aqueous thickened bleach composition according to claim 11 wherein the alkali metal carboxylate constituent comprises a C18 and a C16 fatty acid carboxylate wherein the C18 fatty acid carboxylate to C16 fatty acid carboxylate is present in a weight ratio of at least 4:1, and that the fatty acid carboxylate constituent contains less than 7% wt. of other alkali metal carboxylates having higher or lower alkyl chain lengths.

17. A composition according to claim 11 which is substantially phosphate free.

18. A composition according to claim 11 which is substantially free of further thickener constituents.

19. A process for the production of an aqueous thickened bleach composition which comprises:

a) alkali metal carboxylate which comprises at least 75% wt. of C16 to C18 fatty acid carboxylates, not more than 15% wt. of one or more C20, C22 and higher fatty acid carboxylates, and not more than 15% wt. of one or more C14, C12 and lower fatty acid carboxylates based on the total weight of the alkali metal carboxylate present in the compositions;

b) alkali metal salt;

c) water dispersible nonionic amine oxide;

d) water dispersible anionic surfactant system including one or more sulfate or sulfonate surfactants;

e) an alkali metal or alkaline earth metal hypochlorite;

f) pH adjusting agent;

g) a particulate abrasive material;

h) a detergency builder; and, the balance to 100% wt., water;

which process includes the process steps of:

forming a first premix of water and the alkali metal salt, forming a second premix of water and the detergency builder, forming a third premix of water and the abrasive material, forming a primary mixture by adding to water an alkali metal hydroxide with a fatty acid carboxylate in acid form to form said alkali metal carboxylate, in situ, and further, adding to the primary mixture the remaining constituents not already present in the said first premix, second premix or third premix, and, the said first premix, second premix or third premix under sufficient agitation to form a homogenous product.

20. A process for the production of an aqueous thickened bleach composition which comprises:

a) alkali metal carboxylate which comprises at least 75% wt. of C16 to C18 fatty acid carboxylates, not more than 15% wt. of one or more C20, C22 and higher fatty acid carboxylates, and not more than 15% wt. of one or more C14, C12 and lower fatty acid carboxylates based on the total weight of the alkali metal carboxylate present in the compositions;

b) alkali metal salt, preferably an alkali metal chloride;

c) water dispersible nonionic amine oxide;

d) water dispersible anionic surfactant system including one or more sulfate or sulfonate surfactants;

e) alkali metal hypochlorite;

f) pH adjusting agent;

g) a particulate abrasive material;

h) detergency builder; and, the balance to 100% wt., water, which process includes the process steps of:

forming a first premix of water and the abrasive material, forming a primary mixture by adding to water an alkali metal hydroxide with a fatty acid carboxylate in acid form to form the alkali metal carboxylate, in situ, and further adding to the primary mixture the remaining constituents not already present in the said first premix, and adding the said first premix under sufficient agitation to form a homogenous product.

21. A composition according to claim 1 which further comprises an alkyl diphenyl ether disulfonate surfactant.

22. A composition according to claim 10 which further comprises an alkyl diphenyl ether disulfonate surfactant.

23. A process according to claim 19 which further comprises an alkyl diphenyl ether disulfonate surfactant.

24. A process according to claim 19 which further comprises an alkyl diphenyl ether disulfonate surfactant.

25. A composition according to claim 1 which comprises a secondary alkyl sulfate.

26. A composition according to claim 10 which comprises a secondary alkyl sulfate.

* * * * *

UNITED STATES PATENT AND TRADEMARK OFFICE
CERTIFICATE OF CORRECTION

PATENT NO. : 5,985,817

DATED : 16 NOVEMBER 1999

INVENTOR(S) : A. THOMAS WEIBEL; ANN MARIE LYNCH; ROSITA GABRIELLA NUNEZ; HELEN B. WANG; PRANIL POORAN HAGROO; LEONARD FEBRUARY

It is certified that error appears in the above-identified patent and that said Letters Patent is hereby corrected as shown below:

At column 19, line 21, after "0.01-10.0" insert --of--.

At column 19, line 23, delete "an" and insert --a--.

Signed and Sealed this

Twenty-seventh Day of June, 2000

*Attest:*

Q. TODD DICKINSON

*Attesting Officer*

*Director of Patents and Trademarks*

UNITED STATES PATENT AND TRADEMARK OFFICE
CERTIFICATE OF CORRECTION

PATENT NO. : 5,985,817

DATED : NOVEMBER 16, 1999

INVENTOR(S) : A. THOMAS WEIBEL; ANN MARIE LYNCH; ROSITA GABRIELLA NUNEZ; HELEN B. WANG; PRANIL POORAN HAGROO; LEONARD FEBRUARY

It is certified that error appears in the above-identified patent and that said Letters Patent is hereby corrected as shown below:

On the title page, at "[73] Assignee:" change "Reckitt & Colman South Africa Ltd." to --Reckitt & Colman South Africa (Pty.) Ltd.--.

Signed and Sealed this

Fifteenth Day of August, 2000

*Attest:*

Q. TODD DICKINSON

*Attesting Officer*

*Director of Patents and Trademarks*